US005509694A

United States Patent [19]

Laurash et al.

[11] Patent Number: 5,509,694

[45] Date of Patent: Apr. 23, 1996

[54] TRI-FOLD LABEL OR BUSINESS FORM

[75] Inventors: David F. Laurash, Bellbrook; Lawrence W. Arway, Kettering; Oleh B. Mudry, Spring Valley, all of Ohio

[73] Assignee: The Standard Register Company, Dayton, Ohio

[21] Appl. No.: 306,939

[22] Filed: Sep. 16, 1994

[51] Int. Cl.[6] ..... B42D 15/00

[52] U.S. Cl. ..... 283/81; 283/101; 283/105; 428/42

[58] Field of Search ..... 283/81, 94, 99, 283/103, 105, 106, 116, 101; 428/40, 41, 42, 43

[56] References Cited

U.S. PATENT DOCUMENTS 4,927,179 5/1990 Ehret et al. ..... 283/81

5,031,939 7/1991 Webendorfer et al. .

5,071,167 12/1991 O'Brien .

5,413,383 5/1995 Laurash et al. ..... 283/81

*Primary Examiner*—David P. Bryant

*Attorney, Agent, or Firm*—Killworth, Gottman, Hagan & Schaeff

[57] ABSTRACT

A tri-fold label or business form is provided. The tri-fold label includes a label ply and a liner ply, both having respective first and second sides. Through a series of die cuts and lines of perforations, first, second, and intermediate panels may be defined on the label ply. An additional panel, one or more side panels, and a removable tab may also be provided. The liner ply remains adhered to portions of the label when folded and applied to a surface to facilitate removal of various panels of the label.

22 Claims, 5 Drawing Sheets

TRI-FOLD LABEL OR BUSINESS FORM

BACKGROUND OF THE INVENTION

This invention relates to a tri-fold shipping label or business form, and more particularly, to a shipping label adapted to be adhered to a substrate such as an envelope, canister or package.

Commercial businesses who supply goods which may be progressively transported along a chain of consumers or returned to the supplier, such as for example, motion pictures, recording media, books, sample goods, and various mail order items, often have difficulty in forwarding or returning the goods to the proper locations. Further, these goods are often accompanied by documentation such as invoices, receipts, forwarding instructions, etc. This additional documentation has a tendency to become misplaced, separated from the goods, or lost. As a result, the chain of documentation can be broken and the goods may be shipped to the wrong location. This results in considerable waste in shipping and transportation charges, lost goods, as well as additional expenses for generation of this additional documentation.

Some attempts have been made to create shipping labels with return cards, receipts, invoices, etc. so as to eliminate the need for additional documentation. Representative of these attempts is O'Brien, U.S. Pat. No. 5,071,167. O'Brien shows a Z-fold combination shipping and return label including an intermediate card connecting the shipping and return portions of the label. The shipping portion of the label includes bands of peripheral adhesive. However, the O'Brien label contains a card with no adhesive as the center label. Thus, the center card can not be adhesively applied once it has been removed from the remainder of the label, increasing its risk for loss. Further, the shipping label has adhesive only on the edge portions of the label so that when the backing is removed, the label does not adhere to the center card. Thus, the shipping label, once removed also cannot be adhesively applied, thereby decreasing its usefulness as a receipt or invoice.

Accordingly, there remains a need in this art for a shipping label which can reduce or eliminate additional documentation accompanying shipped goods required with current labels and reduce the risk of loss or improper handling of those goods.

SUMMARY OF THE INVENTION

This need is met by the present invention whereby a tri-fold label or business form is provided. The tri-fold label/form of the present invention contains panels suitable for placement of a forwarding address as well as panels suitable for invoice or receipt purposes. In this manner, the tri-fold label of the present invention can eliminate the need for additional documentation as well as shipping errors from improperly labeled packages.

In accordance with one aspect of the present invention, a tri-fold label or business form is provided. The tri-fold label/form comprises a label ply and a liner ply, each having first and second sides. The second side of the label ply is coated with an adhesive. The adhesive may be a removable, repositionable or permanent adhesive. Hot-melt, emulsion or solvent-based adhesives may all be employed. Preferably a removable, pressure sensitive adhesive is employed. One skilled in the art will recognize that the adhesive may vary depending on the desired application. The first side of the liner ply has a release coating thereon. The first side of the liner ply contacts the second side of the label ply, while the first side of the label ply is adapted to be printed upon.

In one embodiment of the present invention, the label ply includes a first panel, an intermediate panel, and a second panel. The first panel and the intermediate panel are connected along a first perforated fold line. The intermediate panel and the second panel are connected along a second perforated fold line. The liner ply opposite the intermediate and first panels is die cut interiorly of the edges of the first and intermediate panels.

Due to the interior die cut, when the label ply is removed from the liner ply, such as prior to application to a container or package, a portion of the liner ply remains adhered to the second side of the intermediate and first panels while adhesive is exposed on the second side of the second panel and on the edges of the second side of the first panel. The intermediate and second panels are narrower than the first panel. As a result, when the label is folded along the perforated fold lines and applied to a surface, the second side of the second panel adheres to the surface, the edges of the first panel adhere to the surface, and the intermediate panel is folded between the first and second panels.

The intermediate and second panels can be made narrower than the first panel with a die cut through the label ply. The liner ply opposite the first panel may have additional die cuts thereby defining a top portion along with a center portion and a pair of edge portions. This top portion is adapted to adhere to the surface along with the edge portions providing additional exposed adhesive for anchoring purposes.

In another embodiment of the present invention, for further anchoring, the intermediate panel may include a die cut in the label ply. This die cut defines an upper portion of the intermediate panel which folds with the first panel and extends beyond the intermediate and second panels. The upper portion can then be adhered directly to a surface to help anchor the label.

In an additional embodiment of the present invention, any of the panels, either individually or in combination, may contain a removable die cut tab, preferably in the interior of panels. The die cut tab is fully removable and backed with adhesive so that the tab may be removed and adhered to another surface such as a page in a manifest or log. The tab is preferably rectangular and preferably terminates at one end in a hole punched through both the label ply and liner ply to provide a lifting edge for ease in removing the tab. The liner ply opposite the die cut tab is also die cut and defines an area larger than the area of the tab so that when the liner ply is removed, a portion of liner remains adhered to the second surface of the tab.

In a further embodiment of the present invention, the label may include an additional panel on the label ply. The additional panel may be adjacent either the first or second panels. The additional panel is separated from either the first or second panels by one or more die cuts or lines of perforations through the label ply.

In a still further embodiment of the present invention, the label ply may contain one or more side panels on the label ply. The side panel may be adjacent the intermediate panel, the first or second panels, or a combination of the three. The side panel is also separated by one or more die cuts or lines of perforation through the label ply.

Accordingly, it is an object of the present invention to provide a tri-fold label or business form which can eliminate the need for additional documentation, comprising a label and liner ply with the label ply being divided into a first panel an intermediate panel and a second panel. It is a further object of the present invention to provide a tri-fold label or business form which comprises first second and intermediate panels as well as an additional panel and/or a side panel. These, and other objects and advantages of the present invention will become apparent from the following detailed description, the accompanying drawings, and the appended claims.

DETAILED DESCRIPTION OF THE PREFERRED EMBODIMENTS

The present invention relates to a tri-fold label or business form. The label/form contains panels suitable for preprinted return or forwarding addresses, as well as, for receipt or invoice purposes. Thus, the label/form of the present invention can substantially reduce or eliminate the need for additional documentation accompanying shipped goods and provide for a reliable audit trail of important transactions. As a result, errors in forwarding or returning goods can be minimized. Furthermore, the label/form of the present invention may be printed to contain all necessary shipping and return information in a single pass through a printing device.

Figure 2:
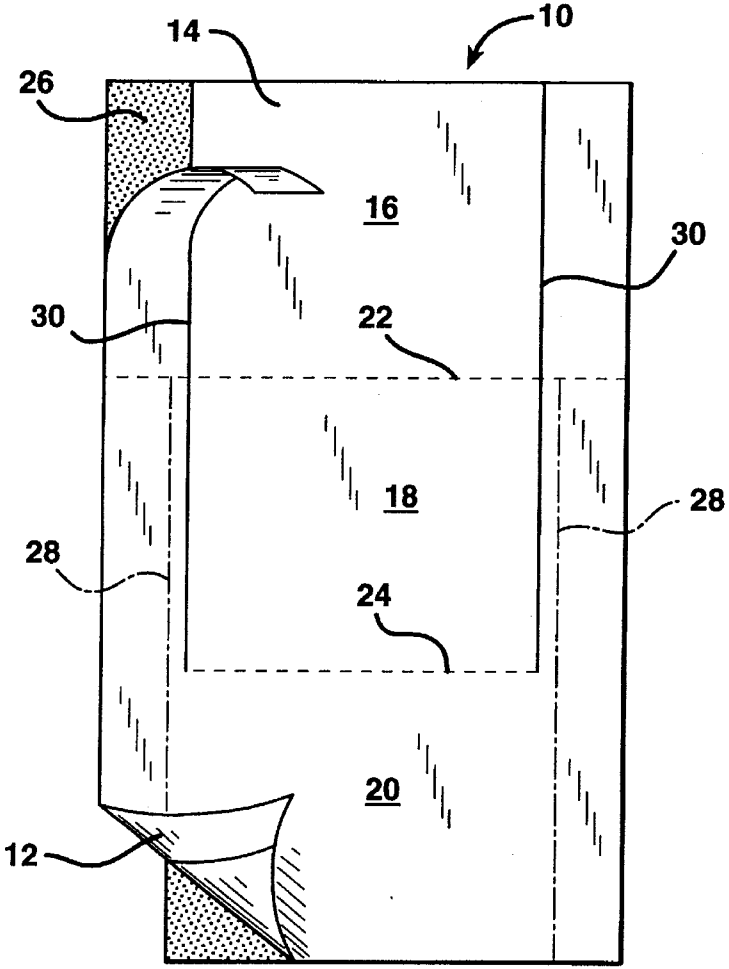
FIG. 2 is a plan view of the back side of the embodiment shown in FIG. 1.
Figure 1:
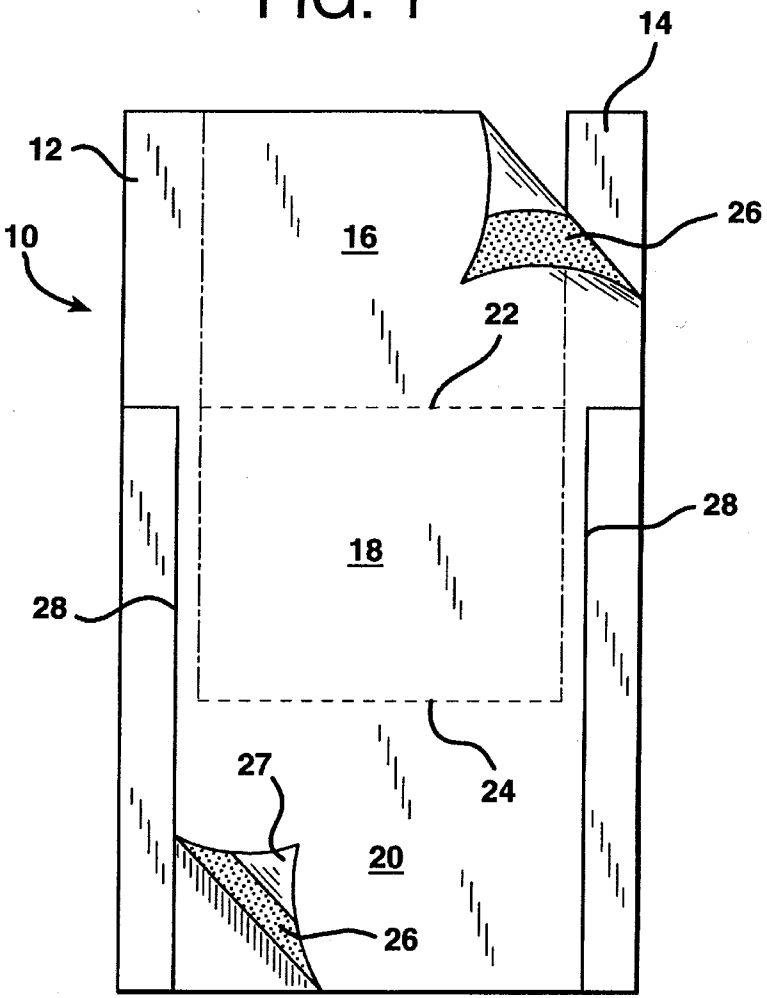
FIG. 1 is a plan view of the front side of one embodiment of the tri-fold label or business form of the present invention.

Although the label/form can be used for a variety of end uses, the invention will be explained with reference to the preferred embodiments in which the label construction performs the combined functions of a shipping label, invoice, customer receipt, common carrier tracking label, warehouse packing list, and a forwarding or returned goods label. Referring now to FIGS. 1 and 2, a first embodiment of tri-fold label or business form of the present invention is shown. Tri-fold label 10 includes a label ply 12 and a liner ply 14, both having first and second sides. The first side of liner ply 14 (facing upward in FIG. 1) includes a release coated surface which may be formed by coating the surface of liner ply 14 which faces the second side of label ply 12 with any conventional release material. The coating may extend over the entire surface of liner ply 14, or may include only selective areas corresponding to the placement of pressure sensitive adhesive on the label ply 12.

Label ply 12 includes a first panel 16, an intermediate panel 18 and a second panel 20. Label ply 12 may be made from paper, coated paper, plastic film, or paper and plastic laminated materials. The selection of the material forming the label ply is generally dependent upon desired end use for the label and the type of printer to be used. The second side of the label ply 12 may be coated with an adhesive 26. Adhesive 26 is preferably a removable or permanent pressure sensitive adhesive, which may be a hot melt, acrylic emulsion or solvent-based adhesive. Such adhesives are known in the art and readily commercially available. While illustrated as continuous, full coatings of adhesives 26, it will be appreciated that the adhesive may be spot or pattern coated as well. As an aid in removing label ply 12 from liner ply 14, a lifting edge 27 may be provided. Lifting edge 27 is free of adhesive 26 to provide an easily grasped clean-lifting edge. Although preferably located on second panel 20, lifting edge 27 may be located in other positions as well.

As shown in FIG. 1, first panel 16 and intermediate panel 18 are connected along a first transverse line of perforations 22. First panel 16 is adapted to be folded along the first line of perforations 22 so that the second side of first panel 16 is in contact with the second side of intermediate panel 18 so that intermediate panel 18 is tucked behind first panel 16 when the label/form 10 is folded to be secured to a substrate such as a package or shipping container.

First panel 16 may include both specific or variable and general or nonvariable information printed thereon and, in the embodiment illustrated, serves as a shipping label. Information specific to each label (i.e. variable information) may include the customer's shipping address, ship date, routing codes, and common carrier tracking codes, such as a bar code (not shown in FIG. 1 but shown in FIG. 3). General information common to many labels (i.e. nonvariable information) may include the shipper's name and logo, shipper's address, and the type of product being shipped. It will be appreciated by those of ordinary skill in the art that the information may vary depending upon the desired end use by a customer and the specific categories of information required.

Intermediate panel 18 may serve as a customer receipt identifying the item purchased and its price. The panel may include both variable and nonvariable information (not shown) printed thereon. The nonvariable information may be preprinted by the manufacturer of the label/form 10 prior to sale and may include generic designations such as "Quantity" and the like. It will be appreciated by those skilled in the art that the nature of the preprinted information will change depending upon the desired end use by a customer and the specific categories of information required by that customer. With this panel, the need to print and supply additional documentation can be substantially reduced or eliminated.

Figure 5:
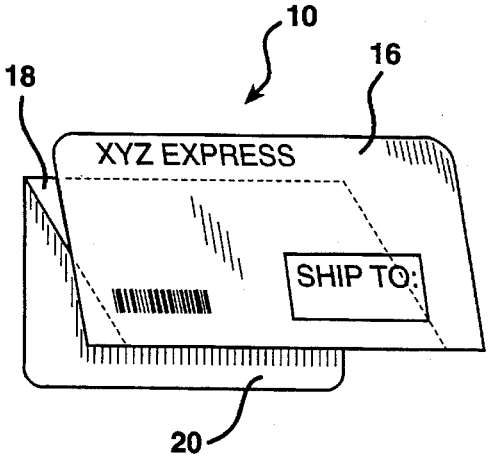
FIG. 5 is a perspective view of the front side of the label ply of FIG. 3 folded along first and second perforated fold lines.

Returning to FIG. 1, intermediate panel 18 is connected to second panel 20 along a second transverse line of perforations 24. Second panel 20 is adapted to be folded along the second line of perforations 24 so that the first side of intermediate panel 18 is in contact with the first side of second panel 20. In this manner, second panel 20 is tucked behind intermediate panel 18 when the label/form 10 is folded to be secured to a substrate such as a package or shipping container. Thus, as can be seen in FIG. 5, when label/form 10 is folded to be secured to a substrate, intermediate panel 18 is tucked between first panel 16 and second panel 20. The first side of first panel 16 is exposed and viewable while the second side of second panel 20 faces the substrate surface.

Second panel 20 may serve as a return or forwarding label. That is, variable information such as a return address, a forwarding address, routing codes, order or purchase numbers, common carrier tracking codes, or the like may be printed on the second panel 20. Because such information on this panel is secured to the goods being shipped, shipping errors and lost goods associated with improper return or forward labelling can be substantially reduced or eliminated.

Variable information identifying a specific purchaser name and order number may be printed on label/form 10 in a single pass through a computer-controlled printer. Suitable printing devices include noncontact printers such as laser and thermal printers, or contact printers such as dot matrix printers. While illustrated as a single sheet, label/form 10 is preferably manufactured using continuous label and liner webs which are coated in predetermined areas with adhesive and release material and then joined together. Individual labels are then formed by die cutting the label or liner ply, removing the salvage or matrix material, perforating the liner ply between labels, and then Z-folding the continuous web to form a connected stack of labels. Depending upon the printing device selected, the continuous web of labels may include marginal prepunched holes to guide the form through the printing device. If a sheet-fed printer is to be used, the continuous web may be cut into individual label/form sheets, and the sheets stacked.

Returning to FIG. 1, intermediate panel 18 and second panel 20 are narrower than first panel 16 as defined by edges 28. This allows first panel 16 to be wider than the remaining panels. Turning to FIG. 2, the liner ply 14 opposite the first panel 16 and the intermediate panel 18, is die cut at 30 interiorly of the edges 28 of the intermediate panel 18 and the second panel 20. Thus, when label ply 12 is removed from the liner ply 14 prior to application to a surface, a portion of the liner ply **14*a* remains adhered to the central portions of the second side of first panel 16 and intermediate panel 18 as shown in FIG. 4**.

Figure 4:
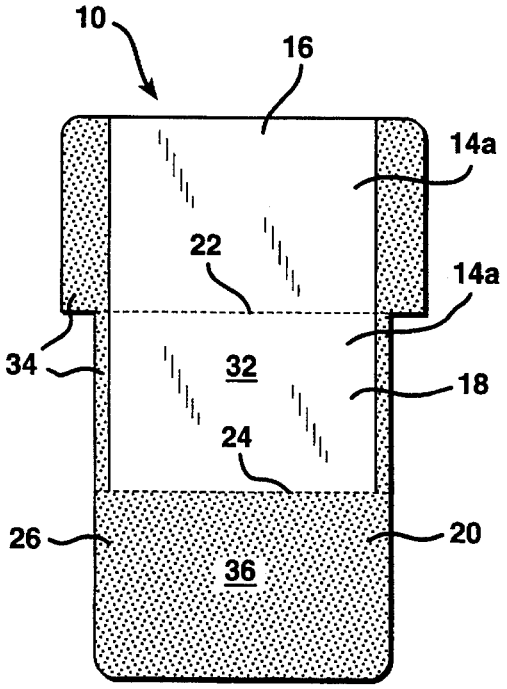
FIG. 4 is a plan view of the back side of the label ply of FIG. 3.
Figure 6:
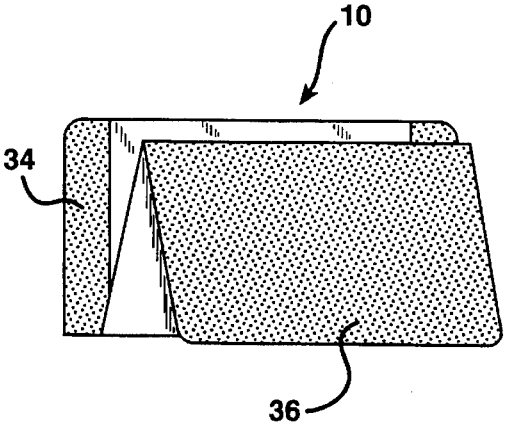
FIG. 6 is a perspective view of the back side of the label ply of FIG. 3 folded along first and second perforated fold lines.

FIG. 4 shows the back side of label/form 10 once label ply 12 has been removed from liner ply 14. As can be seen, liner ply **14*a* remains adhered to the central portions 32 of first panel 16 and intermediate panel 18. Adhesive 26 is then exposed on the edge portions 34 of the first panel 16 and the intermediate panel 18 as well as the entire second surface 36 of second panel 20. Thus, when label/form 10 is folded before application to a surface as shown in FIG. 6, the second surface 36 of the second panel adheres in its entirety to the surface to anchor label/form 10. Edge portions 34** of the first panel also adhere to the surface to anchor the first and intermediate panels to the surface.

As discussed previously, liner ply **14*a* remains adhered to the central portions 32 of first panel 16 and intermediate panel 18 when label ply 12 is removed from liner ply 14. The presence of the portions of liner ply 14*a* prevents the first and intermediate panels from adhering to each other when label/form 10 is folded. This facilitates removal of the first and intermediate panels of the label/form 10** at the appropriate time.

Figure 3:
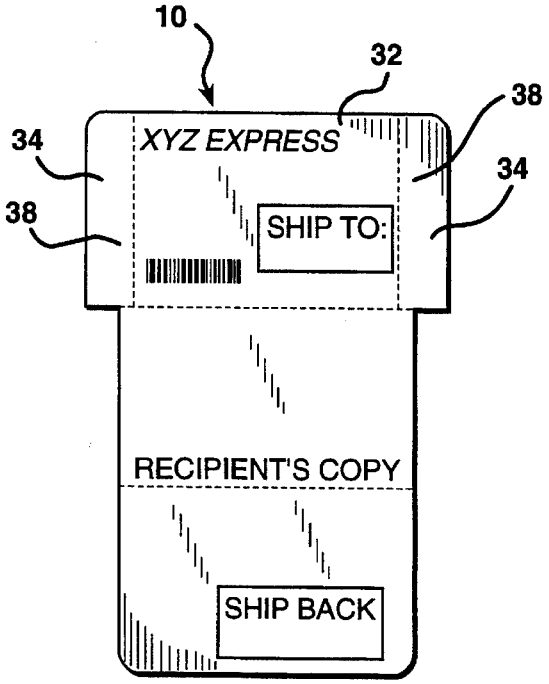
FIG. 3 is a plan view of the front side of the label ply removed from the liner ply in a modification of the embodiment of FIG. 1.

The first and intermediate panels are designed to be easily removed from label/form 10 by tearing the panels along the vertical perforations 38 and second transverse line of perforations, 24 respectively. These panels may then be employed as labels themselves by removing the remaining portions of liner ply **14*a* from the central portions 32, exposing adhesive 26 and applying them to a second surface, such as a receipt log. Once the first panel 16 and the intermediate panel 18 are removed, the printed surface of the second panel (containing a preprinted return or forwarding address, for example) is then clearly visible. To facilitate ease of removal of the first panel 16 once adhered to a surface, additional lines of vertical perforations 38 may be included as shown in FIG. 3. These additional lines of perforations allow the central portion 32 of first panel 16 to be easily separated from the adhered edge portions 34**.

The label ply 12 may be die cut around the edges of the label in various manners to provide a more aesthetically pleasing appearance. As shown in FIGS. 3–5, the corners of the label have been die cut to provide a rounded appearance. While rounded corners have been illustrated, it will be apparent to those skilled in the art, that various other shapes and edges may be employed as desired without departing from the scope of the invention.

Figure 7:
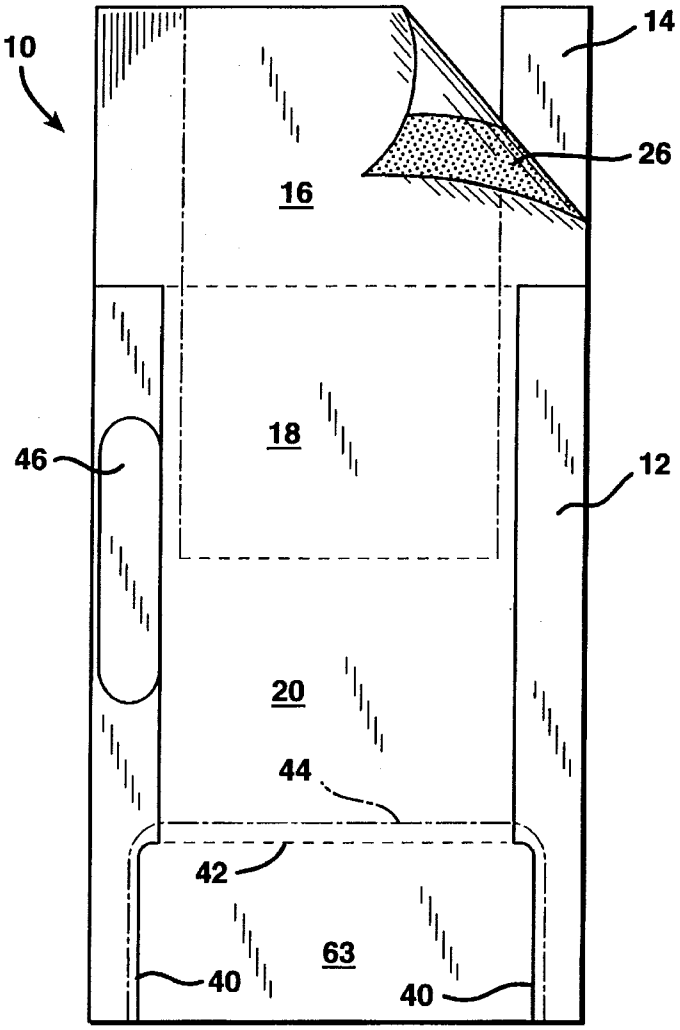
FIG. 7 is a plan view of the front side of an additional embodiment of the present invention containing an additional panel on the label ply.

In an additional embodiment of the tri-fold label or business form of the present invention, an additional panel 63 can be added to the label ply 12. Referring now to FIG. 7, there is seen first panel 16, intermediate panel 18, second panel 20 and additional panel 63. Additional panel 63 may be adjacent second panel 20 as shown or adjacent first panel 16 (not shown). In either case, additional panel 63 is the same. Additional panel 63 is a pull-out panel that can be removed easily and which may be imprinted with additional or duplicate information to form an office or record copy of an order. Additional panel 63 is separated from either the second or first panels by a pair of die cuts 40 in label ply 12 and a third transverse line of perforations 42. So that additional panel 63 can be removed in its entirety if so desired, an additional die cut 44 may be provided in the liner ply 14. Additional panel 63 may then be removed from label/form 10 and used as desired.

In a further embodiment of the present invention, one or more side panels may also be provided. Again referring to FIG. 7, there is seen side panel 46 provided adjacent both intermediate panel 18 and second panel 20. Side panel 46 is separated from the remaining panels with a die cut through the label ply 12. Side panel 46 may be provided on either side of label 10 or it may be provided with multiple side panels on both sides (not shown). Further, side panel 46 may be provided adjacent either the first, intermediate or second panels or a combination of two, such as, intermediate panel 18 and second panel 20 as shown in FIG. 7. Side panel 46 may be printed or colored to show various types of information such as identifying types of delivery or various common carriers.

Figure 8:
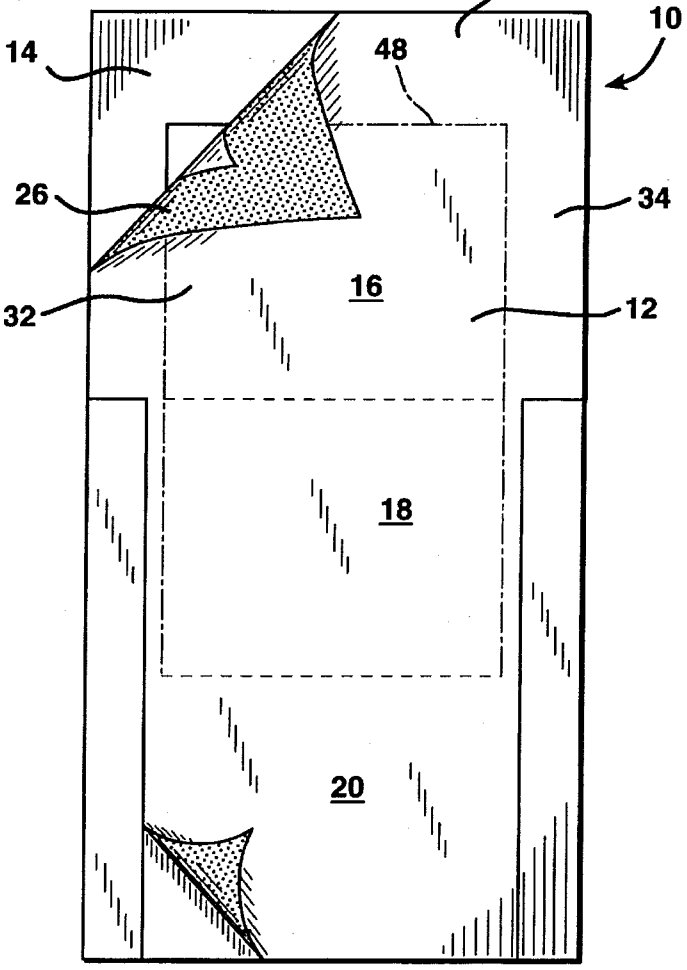
FIG. 8 is a plan view of the front side of a modification of embodiment of FIG. 1.

To provide additional anchoring ability for the first panel, label/form 10 may be provided with additional die cuts in liner ply 14 so that additional adhesive is exposed. Turning to FIG. 8, there is seen label/form 10, with label ply 12, liner ply 14, adhesive 26, first panel 16, second panel 20 and intermediate panel 18. As can be seen, liner ply 14 opposite first panel 16 has been provided with an additional die cut 48, thereby defining a top portion 50 along with central portion 32, and edge portions 34. This top portion provides additional exposed adhesive once label ply 12 is removed from liner 14. The additionally exposed adhesive helps anchor first panel 16 to the substrate surface once the folded label is applied to the surface.

Figure 10:
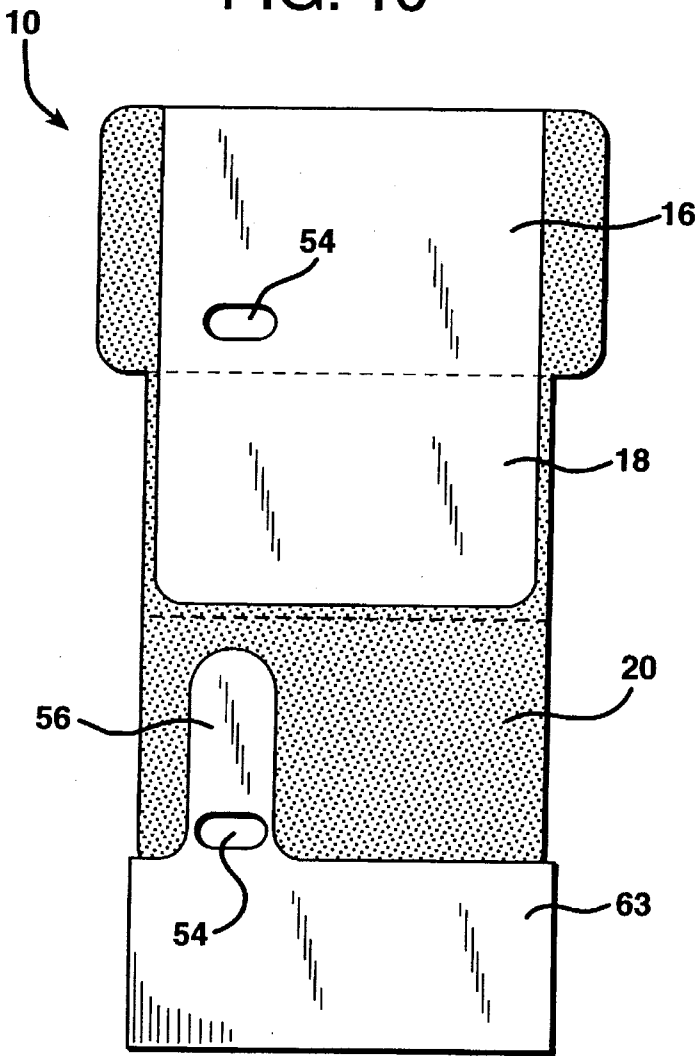
FIG. 10 is a plan view of the back side of the label ply and removable die cut tabs of FIG. 9.
Figure 9:
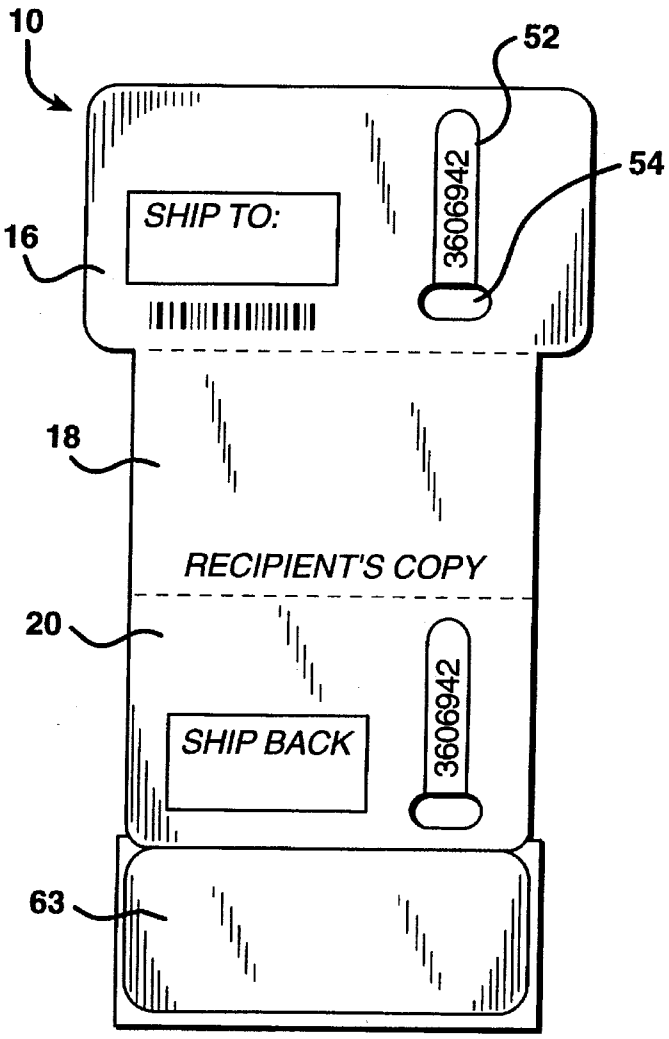
FIG. 9 is a plan view of the front side of the label ply of FIG. 7 removed from the liner ply and containing removable die cut tabs.

In a further embodiment of the present invention, label 10 may be provided with a removable die-cut tab. Referring to FIG. 9, there is seen label 10 with a removable die cut tab 52. The die cut tab is preferably a generally rectangular shape although the tab may assume any shape desired. The tab 52 preferably terminates at one end in a hole 54 punched through both the label and liner plys. The die cut tab may be provided in any of the first, intermediate or second panels or combinations of those panels. The tab also may be located in generally any orientation and position within each panel. Turning to FIG. 10, it can be seen that if the die cut tab 52 is provided in second panel 20, a portion of liner ply 56 is left opposite the die cut tab to prevent the tab from adhering to the substrate surface and to permit its removal. Removable tab 52 is ideally suited for placement of an order or purchase number. The tab can then be removed and placed in a manifest log. However, one skilled in the art will recognize that various other information may also be placed on tab 52 as desired by the customer.

In an additional embodiment of the present invention, an optional self-contained carbonless imaging coating may be placed on the first side of liner ply 14 in an area which has not been coated with release material. This particular version of the invention may be used when the label/form is imaged by an impact printing device such as a dot matrix printer or typewriter. Application of an imaging force on label ply 12 causes a duplicate image to be formed on the first surface of liner ply 14. Thus, liner ply 14 may be used as a record or duplicate office copy of the information printed onto label ply 12.

Figure 11:
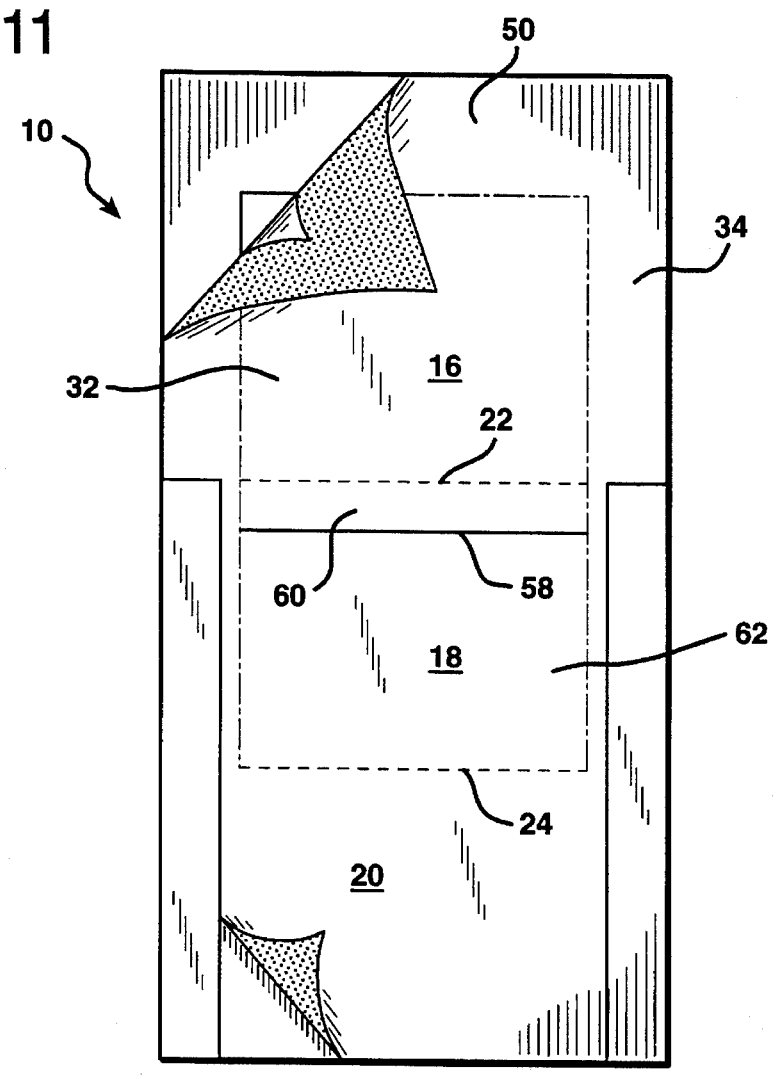
FIG. 11 is a plan view of the front side of an additional embodiment of the label of the present invention.

In an additional embodiment of the present invention, to provide yet further exposed adhesive to help anchor label 10, an additional die cut 58 may define a top portion 60 on intermediate panel 18. Turning to FIG. 11, there is seen label 10 having first panel 16, second panel 20 and intermediate panel 18. Again, the panels are separated by perforated fold lines 22 and 24. As in FIG. 8, die cuts on liner ply 14 define a top portion 50, edge portions 28 and center portion 32 on first panel 16. An additional die cut 58 on the label ply of intermediate panel 18 then defines an upper portion 60 and a lower portion on the intermediate panel.

Figure 12:
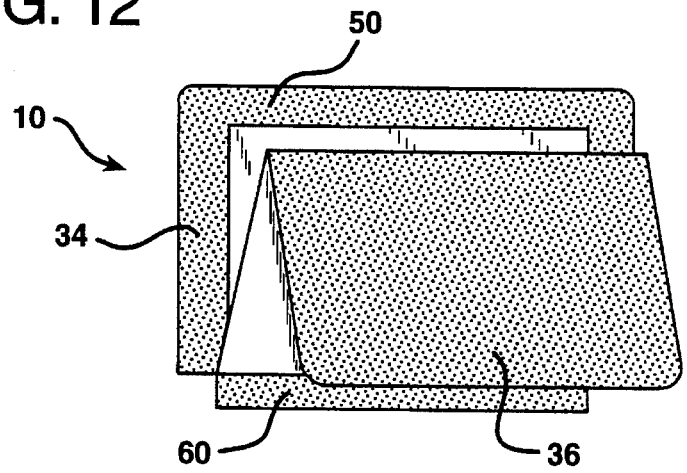
FIG. 12 is a perspective view of the back side of the label ply of FIG. 11 removed from the liner ply and folded along the perforated fold lines.

When label ply is then removed from liner ply 14 and folded along the perforated fold line 24 and the outer ends of line 22, intermediate panel 18 splits along the die cut 58 rather than folding at 22. Thus top portion 60 remains in the same plane as first panel 16. Consequently, adhesive is exposed on the second side of upper portion 60. Upper portion 60 now extends beyond second panel 20 and lower portion 62 as shown in FIG. 12 and is free to adhere to the substrate surface.

The self-contained image coating may be a full coating under the release coating of substantially the entire first side of liner ply 14 or may be spot coated only on predetermined areas. Further, coated front (CF) and coated back (CB) carbonless imaging coatings may be applied, respectively, to the first side of liner ply 14 and the second side of label ply 12 to achieve the same result. In that instance, the coating of release material on the first side of liner ply 14 and adhesive on the second side of label ply 12 should be applied only to selected areas outside the carbonless coated areas so as not to interfere with formation of the carbonless images.

While certain representative embodiments and details have been shown for the purposes of illustrating the invention, it will be apparent to those skilled in the art that various changes in the methods and apparatus disclosed herein may be made without departing from the scope of the invention, which is defined in the appended claims.

What is claimed is:

1. A tri-fold label or business form comprising:

a label ply having first and second sides with said second side coated with an adhesive; said label ply including a first panel having a pair of edge portions, an intermediate panel connected along a first perforated fold line to said first panel, and a second panel connected along a second perforated fold line to said intermediate panel; and, a liner ply having first and second sides, said first side of said liner ply having a release coating thereon and contacting said second side of said label ply, said liner ply opposite said intermediate panel and said first panel being die cut interiorly of the edges of said first and intermediate panels of said label ply;

whereby when said label ply is removed from said liner ply, a portion of said liner ply remains adhered to a central portion on said second side of said first and intermediate panels, and adhesive is exposed on said second side of said second panel and on said edge portions of said second side of said first panel, said intermediate and second panels being narrower than said first panel such that when said label assembly is folded and applied to a surface, said second side of said second panel directly adheres to said surface, with said first panel exposed and having said edge portions adhered to said surface, with said intermediate panel folded there between.

2. The tri-fold label or business form of claim 1 in which said adhesive is a removable or permanent pressure sensitive adhesive.

3. The tri-fold label or business form of claim 1 including an additional panel of label ply carried on said liner ply adjacent either said first or second panels but separated therefrom by one or more die cuts or lines of perforation.

4. The tri-fold label or business form of claim 1 wherein said liner ply opposite said first panel further includes die cuts defining a top portion, or said label ply on said intermediate panel includes a die cut defining an upper portion or both so that when said label ply is removed from said liner ply, adhesive is exposed on said second surface of said top and/or upper portions.

5. The tri-fold label or business form of claim 1 in which said first panel, intermediate panel, second panel or combinations thereof include a removable die cut tab.

6. The tri-fold label or business form of claim 5 in which said tab is generally rectangular and terminates at one end thereof at a hole punched through both the label ply and the liner ply.

7. The tri-fold label or business form of claim 6 further including die cuts in the liner ply opposite said die cut tab defining an area larger than the area of said die cut tab.

8. The tri-fold label or business form of claim 1 further including one or more side panels on said label ply adjacent said first panel, said second panel, said intermediate panel or combinations thereof.

9. The tri-fold label or business form of claim 1 further comprising a self-contained carbonless imaging coating on said first side of said liner ply such that upon the application of an imaging force, an image is formed on said liner ply.

10. The tri-fold label or business form of claim 1 further comprising CB and CF carbonless imaging coatings applied respectively on said second side of said label ply and said first side of said liner ply such that upon the application of an imaging force, the coatings combine and an image is formed on said liner ply.

11. A tri-fold label or business form comprising:

a label ply having first and second sides with said second side coated with an adhesive; said label ply including a first panel having a pair of edge portions, an intermediate panel connected along a first perforated fold line to said first panel, and a second panel connected along a second perforated fold line to said intermediate panel; an additional panel of label ply adjacent either said first or second panels but separated therefrom by one or more die cuts, said first panel and/or said second panel including a die cut tab; and, a liner ply having first and second sides, said first side of said liner ply having a release coating thereon and contacting said second side of said label ply, said liner ply opposite said intermediate panel and said first panel being die cut interiorly of the edges of said first and intermediate panels of said label ply;

whereby when said label ply is removed from said liner ply, a portion of said liner ply remains adhered to a central portion of said second side of said first and intermediate panels, and adhesive is exposed on said second side of said second panel and on said edge portions of said second side of said first panel, said intermediate and second panels being narrower than said first panel such that when said label assembly is folded and applied to a surface, said second side of said second panel directly adheres to said surface, with said first panel exposed and having said edge portions adhered to said surface, with said intermediate panel folded there between.

12. The tri-fold label or business form of claim 11 in which said adhesive is a removable or permanent pressure sensitive adhesive.

13. The tri-fold label or business form of claim 11 wherein said liner ply opposite said first panel further includes die cuts defining a top portion, or said label ply on said intermediate panel includes a die cut defining an upper portion or both so that when said label ply is removed from said liner ply, adhesive is exposed on said second surface of said top and/or upper portions.

14. The tri-fold label or business form of claim 11 in which said tab is generally rectangular and terminates at one end thereof at a hole punched through both the label ply and the liner ply and includes die cuts in the liner ply opposite said die cut tab defining an area larger than the area of said die cut tab.

15. The tri-fold label or business form of claim 11 further including one or more side panels on said label ply adjacent said first panel, said second panel, said intermediate panel or combinations thereof.

16. The tri-fold label or business form of claim 11 further comprising a self-contained carbonless imaging coating on said first side of said liner ply such that upon the application of an imaging force, an image is formed on said liner ply.

17. The tri-fold label or business form of claim 11 further comprising CF and CB carbonless imaging coating applied respectively on said second side of said label ply and said first side of said liner ply such that upon the application of an imaging force, the coatings combine and an image is formed on said liner ply.

18. A tri-fold label or business form assembly comprising in combination:

an article; and a label secured to a surface of said article, said label having first and second sides with said second side coated with an adhesive; said label including a first panel having a pair of edge portions, an intermediate panel connected along a first fold line to said first panel, and a second panel connected along a second fold line to said intermediate panel, said intermediate panel having a liner ply adhered to said second side, said first panel having a liner ply adhered to a central portion of said second side with said edge portions exposed, said intermediate and second panels being narrower than said first panel, said label being folded along said fold lines so that said second side of said first panel is in contact with said second side of said intermediate panel and said first side of said intermediate panel is in contact with said first side of said second panel, said second panel and said edge portions of said first panel being adhered to said package.

19. The tri-fold label or business form assembly of claim 18 in which said adhesive is a removable or permanent pressure sensitive adhesive.

20. The tri-fold label or business form assembly of claim 18 in which said first panel, intermediate panel, second panel or combinations thereof include a die cut tab.

21. The tri-fold label or business form assembly of claim 20 in which said tab is generally rectangular and terminates at one end thereof at a hole punched through both the label ply and the liner ply.

22. The tri-fold label or business form assembly of claim 18 further including a top portion on said first panel, an upper portion on said intermediate panel or both which directly adhere to said package.

* * * * *